United States Patent [19]

Hanakura

[11] Patent Number: 4,854,332

[45] Date of Patent: Aug. 8, 1989

[54] CIGARETTE HAVING THERMOCHROMOGENIC PORTIONS THEREON

[75] Inventor: Niichi Hanakura, Osaka, Japan

[73] Assignee: Sakura Color Products Corp., Osaka, Japan

[21] Appl. No.: 70,229

[22] Filed: Jul. 6, 1987

[30] Foreign Application Priority Data

Jul. 3, 1986 [JP] Japan ..... 61-102905[U]
Jun. 19, 1987 [JP] Japan ..... 62-153883

[51] Int. Cl.[4] ..... A24D 1/02
[52] U.S. Cl. ..... 131/365; 131/270
[58] Field of Search ..... 131/365, 270

[56] References Cited

U.S. PATENT DOCUMENTS 2,193,439 3/1940 Van Doren ..... 131/365

*Primary Examiner*—V. Millin
*Attorney, Agent, or Firm*—Wenderoth, Lind & Ponack

[57] ABSTRACT

A cigarette having thereon a reversible thermochromogenic portion which changes color at a temperature in the range of about 40°-80° C. on the surface except the free end area which makes contact with lips of a smoker, the portion including a thermochromogenic composition which comprises:

(a) an electron donating organic compound as a chromogenic compound;

(b) an aromatic compound having at least one phenolic hydroxyl, or at least one carboxyl connected directly to the aromatic nucleus, or both, or an metal salt of these, as a color developer; and (c) a desensitizer which melts at a temperature in the range of about 40°-80° C.

Said thermochromogenic composition changes color reversibly at a temperature at or near the temperature at which the desensitizer melts.

When one smokes deeply and strongly, the thermochromogenic portion or area provided on the surface of the cigarette apart from the lighted end reaches a temperature at which the desensitizer melts, the portion or area changes color, or gives a visual warning, to let the smoker know that his smoking might be hazardous to his health.

10 Claims, 3 Drawing Sheets

CIGARETTE HAVING THERMOCHROMOGENIC PORTIONS THEREON

This invention relates to a cigaret which has on the surface a reversible thermochromogenic portion or area to warn a smoker that his smoking might be hazardous to his health.

It has been well known for a long time that when one smokes, some organic materials such as nicotine, polycondensed aromatic compounds or tar which are contained in a cigarette evaporate into the air, but some are absorbed into one's lungs. It is said that such organic materials absorbed into lungs might be hazardous to the health.

Therefore, almost all cigarettes now on the market have acetate filters at the tips to adsorb such organic materials as above with the filters thereby to decrease the amount of the materials absorbed into lungs. It is further said to be effective for decreasing the absorption of the materials to use a pipelet which contains a filter having activated carbons dispersed therein.

On the other hand, it is also known that the amount of the organic materials absorbed into a smoker's lungs depends more or less upon the manners in which he smokes, typically whether he smokes deeply and strongly, or whether he smokes until a cigarette becomes short, i.e., whether how long he leaves a cigarette unsmoked.

No cigarette has been heretofore known which visually warns a smoker to about what temperature the surface of the cigarette has reached and whether or not his smoking might be hazardous to his health.

It is, therefore, an object of the invention to provide a cigarette which thereon has a thermochromogenic portion or area to change color and visibly warn a smoker when his smoking might be hazardous to his health.

The cigarette of the invention has a reversible thermochromogenic portion which changes color at a temperature in the range of about 40°–80° C. on the surface except the free end area which makes contact with lips of a smoker, the portion including a thermochromogenic composition which comprises:

(a) an electron donating organic compound as a chromogenic compound;

(b) an aromatic compound having at least one phenolic hydroxyl, or at least one carboxyl connected directly to the aromatic nucleus, or both, or an metal salt of these, as a color developer; and (c) a desensitizer which melts at a temperature in the range of about 40°–80° C.

The cigarettes include paper cigarettes and cigars in the invention.

The thermochromogenic composition per se which changes in color reversibly at a temperature is already known, as disclosed in U.S. Pat. No. 4,028,118 and Japanese Patent Publications No. 60-52189 and No. 62-24473. The thermochromogenic composition includes: (a) an electron donating organic compound as a chromogenic compound; (b) an aromatic compound having at least one phenolic hydroxyl, or at least one carboxyl connected directly to the aromatic nucleus, or both, or a metal salt of these aromatic compounds, as a color developer; and (c) a desensitizer which melts at elevated temperatures to control a color changing temperatures of the composition.

The chromogenic compound develops or changes color when being reacted with a color developer, and more than hundreds of such compounds are known as a chromogenic material used in carbonless pressure sensitive copy sheet. Any of these known chromogenic compounds may be used in the invention. However, the chromogenic compound used in the invention is preferably substantially colorless per se when not being combined with a color developer which will hereinafter described. These chromogenic compounds include, for example, triphenylmethane phthalides, fluorans, phenothiazines, indole phthalides, leucoauramines, spiropyrans and rhodamine lactams.

Examples of these chromogenic compounds include Crystal Violet lactone, Malachite Green lactone, Michler's hydrol, N-benzoyl auramine, Rhodamine B lactam, N-phenyl auramine, 2-(phenyliminoethylidene)-3,3-dimethylindoline, N,3,3-trimethylindolinobenzospiropyran, 8'-methoxy-N,3,3-trimethylindolinobenzospiropyran, 3-diethylamino-6-methyl-7-chlorofluoran, 3-diethylamino-7-methoxy-fluoran, 3-diethylamino-6-benzyloxyfluoran, 1,2-benzo-6-diethylaminofluoran, 3-amino-5-methylfluoran, 2-methyl-3-amino-6-methyl-7-methylfluoran, 3-diethylamino-7-anilinofluoran, 3-diethylamino-7-(p-toluidino)fluoran, 2-bromo-6-cyclohexylaminofluoran, 2,7-dichloro-3-methyl-6-n-butylaminofluoran and the like. These chromogenic compounds may be used singly or as a mixture of two or more depending upon a designed color change of the thermochromogenic portion formed on cigarettes.

The chromogenic compound develops or changes color when being reacted with a color developer, possibly through an electron donating/accepting reaction therebetween, although definite mechanisms have not been clarified and the invention is not restricted to any theory of the color change.

The color developer is an aromatic compound having at least one phenolic hydroxyl or at least one carboxyl connected directly to the aromatic nucleus, or both. The color developer preferably used in the invention includes, for example, 4-tert.-butylphenol, nonylphenol, dodecylphenol, p-bromophenol, o-bromophenol, 4-hydroxydiphenyl ether, α-naphthol, β-naphthol, methyl p-hydroxybenzoate, propyl p-hydroxybenzoate, octyl p-hydroxybenzoate, dodecyl p-hydroxybenzoate, p-tert.butylcatechol, p-hydroxyacetophenone, 2,2'-methylenebis(4-methyl-6-tert.-isobutylphenol), p-phenylphenol, o-phenylphenol, o-(o-chlorophenyl)-phenol, p-(p-chlorophenyl)phenol, 4,4'-isopropylidene diphenol (bisphenol A), 2,2'-methylenebis(4-chlorophenol), 4,4'-thiobis(6-tert.-butyl-3-methylphenol), 1,1-bis(4-hydroxyphenyl)cyclohexane, 4,4'-butylidene bis(6-tert.-butyl-3-methylphenol), hydroquinone, 2-hydroxy-1-naphthoic acid, 2,4-dihydroxybenzophenone, 2,4,6-trihydroxymethylbenzene, 2-hydroxy-p-toluic acid, salicylic acid, m-hydroxybenzoic acid, 4-hydroxyphthalic acid, phloroglucine carboxylic acid, gallic acid, propyl gallate and phthalic acid.

Metal salts of the above aromatic compounds are also usable as a color developer in the invention. These metal salts include, for example, sodium, potassium, lithium, calcium, zinc, zirconium, aluminum, magnesium, nickel, cobalt, copper, tin, iron, vanadium, titanium and molybdenum salts.

The thermochromogenic composition used in the invention contains a developer in amounts of about 1–15 parts, preferably about 1–5 parts by weight, in relation to 1 parts by weight of the chromogenic compound.

The thermochromogenic composition used in the invention further contains a desensitizer which melts at a narrow range of temperatures between about 40° C. and about 80° C., preferably between about 45° C. and about 60° C. The thermochromogenic composition used in the invention is therefore a mixture of the chromogenic compound, color developer and desensitizer, either as a solid solution or a solid dispersion in a solid desensitizer, below the melting points of the desensitizer used.

The composition develops a color based on the combination of the chromogenic compound and the color developer when the desensitizer is solid, whereas the composition is usually substantially colorless when the desensitizer is melted. Namely, the thermochromogenic composition changes color reversibly at the temperature at which the desensitizer melts. In some cases, the melting point of a desensitizer is not exactly the same as the temperature at which the desensitizer melts in the composition. However, a desensitizer usually at nearly the same temperature as the melting point of the desensitizer itself, so that a suitable desensitizer may be selected in view of the melting point of a desensitizer.

The desensitizer usable in the invention includes higher fatty acids, higher fatty alcohols, higher aliphatic ketones, higher fatty acid amides, higher fatty acid esters, higher fatty acid glycerides, polyalkylene glycols, polyalkylene glycol ethers, polyalkylene glycol amines, polyalkylene glycol esters, polyalkylene glycol ether esters and alkanol amines. More specifically, the higher fatty acids include, for example, lauric acid, myristic acid, stearic acid, palmitic acid, arachidic acid, behenic acid, lygnoceric acid and cerotic acid; the higher fatty alcohols include, for example, stearyl alcohol, palmityl alcohol and lauryl alcohol; the higher fatty acid esters include, for example, butyl myristate, butyl palmitate, methyl stearate, ethyl stearate, propyl stearate, octyl stearate, butyl oleate and octyl oleate; the higher alihatic ketones include, for example, stearone, palmitone and laurone; and the higher fatty acid amides include, for example, stearyl amide, palmityl amide and lauryl amide; and higher fatty acid glycerides include, for example, caprylic triglyceride, capric triglyceride, lauric triglyceride, palmitic triglyceride and stearic triglyceride.

The desensitizer may be composed either of a single compound or a mixture of two or more of the compounds, and it is possible to control the melting point of the desensitizer, or a color changing temperature of the thermochromogenic composition, by use of two or more of the compounds. The desensitizer is incorporated into the thermochromogenic composition in amounts of about 5–200 parts by weight, preferably about 50–150 parts by weight, in relation to 1 part by weight of the chromogenic compound.

As hereinbefore described, the thermochromogenic composition has a color when the desensitizer is solid, whereas the composition is usually substantially colorless when the desensitizer is melted. Therefore, when a cigarette has a portion or area thereon which includes the abovementioned thermochromogenic composition, the portion changes in color, usually from a color based on the combination of the chromogenic compound and the color developer, to substantially colorless, when the portion has reached the temperature at which the desensitizer melts. This color change warns a smoker that his smoking or conditions might be sufficiently deep or strong to be hazardous to his health.

The thermochromogenic composition may change in color from a first to a second color when it contains a pigment which is insensitive to temperature change, in place of a color change from a color based on the combination of the chromogenic compound and the color developer, to substantially colorless. This thermochromogenic composition has a first color based both on the combination of the chromogenic compound and the color developer and on the thermally insensitive pigment when the desensitizer is solid, whereas the composition shows a second color based on only the thermally insensitive pigment when the desensitizer is melted. When a cigarette has such a thermochromogenic portion, it gives a smoker an warning by a change of color from a first to a second color.

The thermochromogenic portion may also change in color from a first to a second color when the thermochromogenic portion is composed of two layers of an underlayer formed with thermally insensitive pigments and an overlayer formed with the thermochromogenic composition which is substantially colorless when the desensitizer is melted. The portion has a first color based on the combination of the chromogenic compound and the color developer when the desensitizer is solid since the overlayer hides the underlayer, whereas the portion has a second color based on the thermally insensitive pigments when the desensitizer is melted and the overlayer is substantially transparent.

The thermochromogenic composition is desirably enclosed in microcapsules so that the thermochromogenic portion on a cigarette may reversibly change color sensitively whenever the desensitizer melts or solidifies for a long time. Such microcapsules may be produced by a method which is known in the production of microcapsules for use in carbonless pressure sensitive copy sheet. More specifically, the microcapsules containing the thermochromogenic composition therein and preferably for about 1–50 microns in diameter are formed into a microcapsule ink composition by dispersing the microcapsules in a binder material, either water base or oil base, in amounts of about 10–50% by weight based on the ink composition. The binder material usually contains a solvent and a resin, and if needed, may further contain other additives such as a defoaming agent, a thickener, an antioxidant or an ultraviolet absorbent.

The method of producing a microcapsules containing pigments has been established in the field of carbonless pressure sensitive copy sheet, as disclosed in Japanese Patent Disclosures (Unexamined) No. 57-77589 and 59-142836, and also in U.S. Pat. Nos. 3,849,164 and 3,819,398.

The thermochromogenic portion is so provided on a cigarette that the color change takes place apart from the lighted end of the cigarette, and it is not intended that the wall of the microcapsules melts when the desensitizer melts, namely, when the thermochromogenic composition changes color. Therefore, it is necessary that the wall of the microcapsules be composed of resins which do not melt at temperatures of not more than about 65° C., preferably not more than about 80° C. Examples of such resins include, for example, urea-formalin resins, melamine-formalin resins and epoxy resins.

The microcapsules used in the invention are usually produced by use of water as a microcapsulating medium. Therefore, the admixing of the resultant aqueous dispersion of the microcapsules with an water base binder which contains a resin emulsion or an water soluble resin, if needed, together with other additives provides an water base ink composition. The admixing of the microcapsules, after being separated from the aqueous dispersion and dried, with an oil base binder which contains an organic solvent and a resin dissolved therein, if needed, together with other additives provides an oil base ink composition. Hydrocarbons, carboxylic acid esters, ketones or mixtures of these may be used as the organic solvents.

The microcapsule ink composition may further contain a thermally insensitive pigment in the binder. The thermochromogenic portion formed on a cigarette with such an ink composition also changes in color from a first to a second color when the desensitizer melts. The thermochromogenic composition has a first color based both on the chromogenic compound combined with the color developer and on the thermally insensitive pigment when the desensitizer is solid, whereas the composition has a second color based on only the thermally insensitive pigment when the desensitizer is melted to make the chromogenic composition substantially colorless and transparent.

The cigarette of the invention will now be described with reference to drawings, in which.

Figure 1:
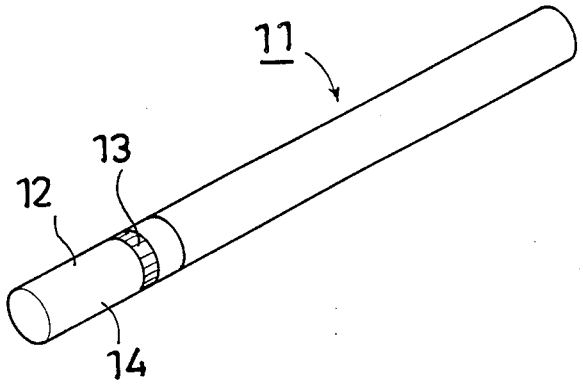
FIG. 1 is a perspective view of one of the simplest embodiments of the cigarette according to the invention.

One of the simplest embodiment of a cigarette of the invention is illustrated in FIG. 1, in which a cigarette 11 has a filter tip 12 at one end, and a single thermochromogenic portions or area 13 is provided in the form of a ring on the surface of filter roll paper 14. The portion may be formed, for example, by printing a predetermined pattern on filter roll paper before a filter is enclosed with the paper.

Figure 2:
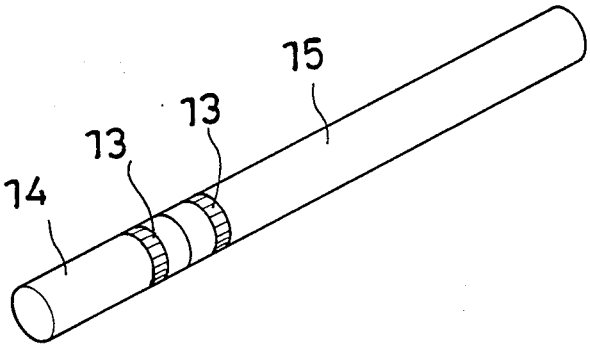
FIGS. 2 and 3 are also perspective views of other embodiments of the cigarette according to the invention.

FIG. 2 shows a further embodiment of a cigarette of the invention which carries two thermochromogenic portions or areas 13 in the form of rings, one on the surface of filter roll paper 14, and the other on the cigarette paper 15.

Figure 3:
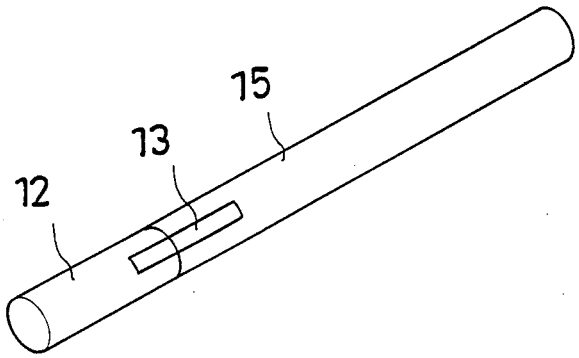

FIG. 3 shows still another embodiment of a cigarette of the invention, in which an elongated thermochromogenic portion 13 is provided over the cigarette paper 15 and filter 12 on the cigarette. In this cigaret, the thermochromogenic portion changes color thermosensitively and continuously from the lighted end towards the filter tip, thus letting a smoker know visually a temperature profile of the cigarette and his smoking are coming near to a critical point which might be hazardous to his health.

Although not illustrated in drawings, the thermochromogenic portion may be formed on the whole surface of cigarette paper or on the whole surface of a filter except on the surface thereof which makes contact with a smoker's lips.

Figure 4:
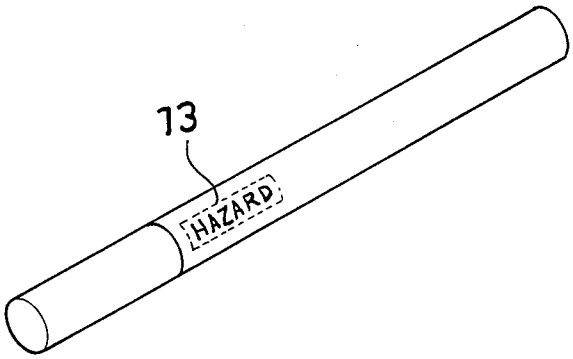
FIG. 4 is a perspective view of a cigarette having a thermochromogenic portion thereon formed with letters according to the invention.
Figure 5:
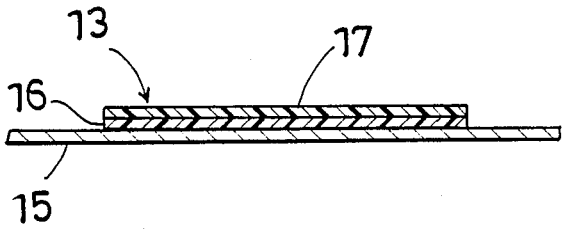
FIG. 5 is an enlarged sectional view of the thermochromogenic portion shown in FIG. 4.

As illustrated in FIGS. 4 and 5, a cigarette of the invention may have a two layer thermochromogenic portion 13 which is composed of an underlayer 16 having letters or words such as "HAZARD" printed on cigarette paper 15 with an ink composition containing pigments which do not change color thermosensitivly, i.e., thermally insensitive pigments, but containing no thermochromogenic composition, and on overlayer 17 printed on the underlayer with an ink composition which contains a thermochromogenic composition. When one smokes in a mild and safe manner, this thermochromogenic portion has a temperature lower than the color changing temperature and the desensitizer contained therein is solid, and the portion has a color and hides the underlayer, making the words invisible. However, when the thermochromogenic portion has reached a color changing temperature and the desensitizer has melted, the thermochromogenic composition becomes colorless and transparent so that one can read the words to know that one's smoking might have reached a hazardous point.

Figure 6:
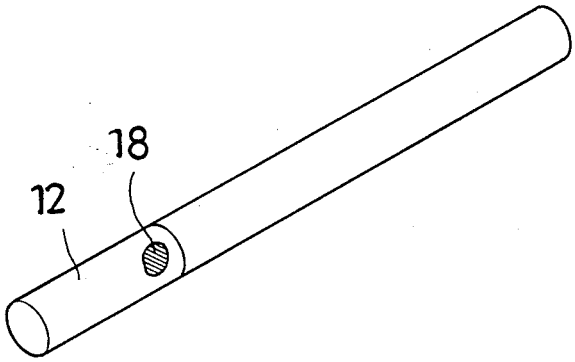
FIG. 6 is a perspective views of a further embodiment of a cigarette according to the invention.

It is preferred that the thermochromogenic portion be formed on cigarette paper or filter roll paper by printing patterns or letters thereon prior to the rolling of tobacco or filters. However, as illustrated in FIG. 6, the portion may be formed on, for example, a filter 12 by glueing thereonto a seal or a sheet 18 of desired patterns containing a thermochromogenic composition. The portion may be of any form, for example, circular, triangular, quadrangular, starlike, or elongated.

When one smokes a cigarette of the invention, a temperature profile is continuously formed along the cigaret highest at the lighted end. Therefore, when one smokes deeply and strongly, the thermochromogenic portion or area provided on the surface of the cigarette either near or far apart from the lighted end, reaches a temperature depending upon the manners in which one smokes, and when the temperature where the portion is provided has reached a melting point of a desensitizer in the thermochromogenic composition, the portion or area changes color, or develops warning words. The color change or warning lets the smoker know that his manners of smoking cause the vaporization of a large amount of nicotine, fused aromatic compounds or tar in the air, and not a small amount of these materials are absorbed into his lungs, and it might be hazardous to his health.

When the smoker accepts the warning and smokes thereafter less deeply and less strongly, the portion reversibly changes color, usually to colorless, since the temperatures of the portion decreases below the melting point of the desensitizer and it becomes solid. This reverse color change therefore lets a smoker know that he smokes in safe manners.

However, even when a smoker's manners are sufficiently mild, a large amount of organic materials might be absorbed into his lungs by smoking a cigarette short nearly to the filter. It is therefore useful to provide a thermochromogenic portion or area on a filter or on cigarette paper near to the filter, since the portion changes color when one smokes a cigarette until it becomes short, to cause a color change of the portion even when one smokes sufficiently mild. This color change lets a smoker know that he must smoke that cigarette no more.

The invention will be more easily understood with reference to the following examples, which, however, describe the preparation of thermochromogenic compositions, microcapsules containing the compositions, and ink compositions containing the microcapsules, and temperatures and manners or modes of color change of the thermochromogenic compositions and the ink compositions.

EXAMPLES (a) Preparation of Thermochromogenic Compositions

The following thermochromogenic compositions A to D were prepared. Parts are parts by weight when otherwise indicated.

| Thermochromogenic Composition A | |
|---|---|
| Palmitic acid | 20 |
| Stearic acid | 40 |
| Arachidic acid | 40 |
| Bisphenol A | 2 |
| Crystal Violet Lactone | 1 |

This composition was found to change color at about 58° C.; colorless at temperatures not less than about 58° C., but blue at temperatures below about 58° C.

| Thermochromogenic Composition B | |
|---|---|
| Myristic acid | 100 |
| Bisphenol A | 2 |
| Fluoran Dye NC-R (Hodogaya Kagaku Kogyo K.K., Japan) | 1 |

This composition was found to change color at about 50° C.; colorless at temperatures not less than about 50° C., but red at temperatures below about 50° C.

| Thermochromogenic Composition C | |
|---|---|
| Palmitic acid | 60 |
| Stearic acid | 40 |
| Bisphenol A | 2 |
| Crystal Violet Lactone | 1 |

This composition was found to change color at about 55° C.; colorless at temperatures not less than about 55° C., but blue at temperatures below about 55° C.

| Thermochromogenic Composition D | |
|---|---|
| Palmitic acid<br>Stearic acid | 40 |
| Myristic Myristic acid | 40 |
| Bisphenol A | 2 |
| Fluoran Dye NC-R | 1 |

This composition was found to change color at about 45° C.; colorless at temperatures not less than about 45° C., but red at temperatures below about 45° C.

| Thermochromogenic Composition E | |
|---|---|
| Stearyl alcohol | 100 |
| Stearyl amide | 5 |
| Bisphenol A | 4 |
| Fluoran Dye NC-R | 2 |

This composition was found to change color at about 50° C.; colorless at temperatures not less than about 50° C., but red at temperatures below about 50° C.

| Thermochromogenic Composition F | |
|---|---|
| Cetyl alcohol | 30 |
| Stearyl alcohol | 70 |
| Bisphenol A | 4 |
| Crystal Violet Lactone | 2 |

This composition was found to change color at about 46° C.; colorless at temperatures not less than about 46° C., but blue at temperatures below about 55° C.

(b) Preparation of Ink Compositions Containing Microcapsules

Ink compositions containing microcapsules which enclosed the thermochromogenic composition A, B, C or D were prepared. Hereinafter when color changing temperatures and modes are not indicated, they are the same as those of the thermochromogenic compositions contained in the mirocapsules.

An amount of 5 parts of ethylene-maleic anhydride copolymer were heated and dissolved in 95 parts of water, and then resorcinol and urea were added to the resultant aqueous solution in amounts of 1% by weight and 6% by weight, respectively, based on the resultant solution. The solution was then heated at 60° C. for 10 minutes. To 100 parts of the resultant solution were added 100 parts of a melted thermochromogenic composition and stirred, to provide an emulsified solution, followed by adjusting the pH thereof to 3.2 with sodium hydroxide.

An amount of 16 parts of 37% by weight aqueous solution of formalin was added to the emulsion, and the resultant mixture was stirred mildly for 3 hours, and then left standing to room temperatures, to provide aqueous dispersions of microcapsules containing the thermochromogenic composition.

The dispersion was so adjusted to contain the microcapsules in amounts of 50% by weight, and the dispersion was added to an aqueous resin emulsion or an aqueous resin solution, to provide water base ink composition I to VIII.

| Water Base Ink Composition I | |
|---|---|
| Bonron A-450 (Acrylic emulsion by Mitsui Toatsu Kagaku K.K., Japan) | 100 |
| Dispersion containing microcapsules of thermochromogenic composition A | 80 |
| Reozic 252L (Polyacrylic acid sodium salt by Nippon Junyaku Kogyo K.K., Japan) | 4 |
| Defoaming agent | 1 |

| Water Base Ink Composition II | |
|---|---|
| Voncoat ES-141 (Acrylic emulsion by Dai-Nippon Ink Kagaku Kogyo K.K., Japan) | 100 |
| Dispersion containing microcapsules of thermochromogenic composition B | 120 |
| Thickener | 8 |
| Defoaming agent | 2 |
| Ryudye W Yellow (Water base pigment by Dai-Nippon Ink Kagaku Koyo K.K., Japan) | 5 |

This ink composition contained a thermally insensitive pigment so that the coating formed therewith was found to be orange at temperatures not less than about 50° C., but yellow at temperatures below about 50° C.

| Water Base Ink Composition III | |
|---|---|
| Kuraray Poval 105 (Polyvinyl Alcohol by K.K. Kuraray, Japan) | 7 |
| Dispersion containing microcapsules of thermochromogenic composition B | 40 |
| Water | 93 |

| Water Base Ink Composition IV | |
|---|---|
| Bonron A-450 | 100 |
| Dispersion containing microcapsules of thermochromogenic composition C | 80 |
| Reozic 252L | 4 |
| Defoaming agent | 1 |
| Ryudye Luminous Rose NF (Water base pigment by Dai-Nippon Ink Kagaku Kogyo K.K., Japan) | 1.6 |
| FFL 2G (Water base pigment by Dainichi-Seika Kogyo K.K., Japan) | 0.064 |

This ink composition contained a thermally insensitive pigment so that the coating formed therewith was found to be pink at temperatures not less than about 55° C., but violet at temperatures below about 55° C.

| Water Base Ink Composition V | |
|---|---|
| Kuraray Poval 105 | 7 |
| Dispersion containing microcapsules of thermochromogenic composition C | 40 |
| Water | 93 |
| New Lacqutimine Color Yellow FLR (Water base pigment by Dainichi-Seika Kogyo K.K., Japan) | 0.24 |

This ink composition contained a thermally insensitive pigment so that the coating formed therewith was found to be yellow at temperatures not less than about 55° C., but green at temperatures below about 55° C.

| Water Base Ink Composition VI | |
|---|---|
| Kuraray Poval 105 | 7 |
| Dispersion containing microcapsules of thermochromogenic composition D | 40 |
| Water | 93 |
| New Lacqutimine Color Yellow FLR | 0.24 |
| Ryudye W Blue RLCH (Water-dispersed pigment by Dai-Nippon Ink Kagaku Kogyo K.K., Japan) | 0.08 |

This ink composition contained a thermally insensitive pigment so that the coating fomed therewith was found to be green at temperatures not less than about 55° C., but brown at temperatures below about 55° C.

| Water Base Ink Composition VII | |
|---|---|
| Kuraray Poval 105 | 7 |
| Dispersion containing microcapsules of thermochromogenic composition D | 40 |
| Water | 93 |

| Water Base Ink Composition VIII | |
|---|---|
| Voncoat ES-141 | 50 |
| Dispersion containing microcapsules of thermochromogenic composition D | 60 |
| Thickener | 4 |

-continued

| Water Base Ink Composition VIII | |
|---|---|
| Defoaming agent | 1 |
| Ryudye W Yellow FF8G | 2.5 |

This ink composition contained a thermally insensitive pigment so that the coating formed therewith was found to be yellow at temperatures not less than about 45° C., but orange at temperatures below about 45° C.

(c) Preparation of Oil Base Ink Compositions Containing Microcapsules

Microcapsules containing the thermochromogenic composition E and F, respectively, were prepared as follows.

An amount of 10 parts of an epoxy resin (Epicoat by Shell Petroleum, U.S.A.) was added to a thermochromogenic composition and the resultant mixture was melted by heating to about 80° C. The melt was added dropwise to 300 parts of a 5% by weight aqueous solution of gelatin, and the resultant mixture was stirred, to provide an emulsion containing oil droplets therein.

An aqueous solution of 6 parts of a curing agent (amine curing agent Epicua by Shell Petroleum, U.S.A.) in 40 parts of water was added dropwise to the gelatin solution under stirring. The resulting mixture was stirred at about 80° C. for 4 hours, and then was left standing with stirring to room temperatures.

The microcapsules were then separated from the thus obtained aqueous dispersion of microcapsules, dried, and then dispersed in an oil base binder in amounts of 50% by weight, to provide oil base ink compositions IX to XII.

| Oil Base Ink Composition IX | |
|---|---|
| Ethocel (Ethylcellulose resin by Dow Chemical Co., U.S.A.) | 5 |
| Toluene | 90 |
| Microcapsules of thermochromogenic composition A | 30 |
| Ceres Yellow GRN (Oil soluble yellow pigment by BASF, West Germany) | 1 |

This ink composition contained a thermally insensitive pigment so that the coating formed therewith was found to be blue at temperatures not less than about 58° C., but green at temperatures below about 58° C.

| Oil Base Ink Composition X | |
|---|---|
| Chlorinated Rubber (Adeka Chlorinated Rubber CR-20 by Asahi Denka Kogyo K.K., Japan) | 10 |
| Toluene | 90 |
| Microcapsules of thermochromogenic composition B | 30 |
| Neozapon FLE (Oil soluble blue pigment by BASF, West Germany) | 1.5 |

This ink composition contained a thermally insensitive pigment so that the coating formed therewith was found to be blue at temperatures not less than about 50° C., but violet at temperatures below about 50° C.

| Oil Base Ink Composition XI | |
|---|---|
| Ethocel | 7 |
| Toluene | 90 |

-continued

| Oil Base Ink Composition XI | |
|---|---|
| Microcapsules of thermochromogenic composition E | 20 |

| Oil Base Ink Composition XII | |
|---|---|
| Rubber Chloride CR-20 | 14 |
| Toluene | 90 |
| Microcapsules of thermochromogenic composition F | 20 |

What is claimed is:

1. A cigarette having thereon a reversible thermochromogenic portion which changes color at a temperature in the range of about 40°-80° C. on the surface except the free end area which makes contact with lips of a smoker, the portion including a thermochromogenic composition which comprises:

(a) an electron donating organic compound as a chromogenic compound;

(b) an aromatic compound having at least one phenolic hydroxyl, or at least one carboxyl connected directly to the aromatic nucleus, or both, or a metal salt of these, as a color developer;

(c) a desensitizer which melts at a temperature in the range of about 40°-80° C. and wherein said thermochromogenic composition changes color reversibly at a temperature at or near the temperature at which the desensitizer melts.

2. The cigaret as claimed in claim 1 wherein the thermochromogenic composition further contains thermally insensitive pigments therein.

3. The cigarette as claimed in claim 1 wherein the thermochromogenic composition is enclosed in microcapsules.

4. The cigarette as claimed in claim 3 wherein the thermochromogenic portion is formed with a ink composition which contains microcapsules in which the thermochromogenic compositioion is enclosed.

5. The cigarette as claimed in claim 4 wherein the ink composition contains thermally insensitive pigments therein.

6. The cigarette as claimed in claim 1 wherein the thermochromogenic portion is composed of two layers of an underlayer formed with thermally insensitive pigments and the overlayer formed with the thermochromogenic composition.

7. The cigarette as claimed in claim 1 wherein at least one thermochromogenic portion is provided in the form of rings on the cigarette.

8. The cigarette as claimed in claim 1 wherein at least one thermochromogenic portion is provided in elongated forms along the length of the cigarette.

9. The cigarette as claimed in claim 1 wherein at least one thermochromogenic portion is provided by glueing a seal or a sheet containing the thermochromoegnic composition onto the cigarette.

10. The cigarette as claimed in claim 1 wherein the desensitizer is a member selected from the group consisting of higher fatty acids, higher fatty alcohols, higher aliphatic ketones, higher fatty acid amides, higher fatty acid esters, higher fatty acid glycerides, polyalkylene glycols, polyalkylene glycol ethers, polyalkylene glycol amines, polyalkylene glycol esters, polyalkylene glycol ether esters and alkanol amines and mixtures thereof.

* * * * *